US011839304B2

(12) United States Patent
Grathwol et al.

(10) Patent No.: US 11,839,304 B2
(45) Date of Patent: Dec. 12, 2023

(54) PIVOT FITTING AND PIECE OF FURNITURE

(71) Applicant: HETTICH FRANKE GMBH & CO. KG, Balingen-Weilstetten (DE)

(72) Inventors: Steffen Grathwol, Balingen (DE); Oliver Nill, Hechingen (DE)

(73) Assignee: HETTICH FRANKE GMBH & CO. KG, Balingen-Weilstetten (DE)

( * ) Notice: Subject to any disclaimer, the term of this patent is extended or adjusted under 35 U.S.C. 154(b) by 85 days.

(21) Appl. No.: 17/611,945

(22) PCT Filed: May 18, 2020

(86) PCT No.: PCT/EP2020/063810
§ 371 (c)(1),
(2) Date: Nov. 17, 2021

(87) PCT Pub. No.: WO2020/234236
PCT Pub. Date: Nov. 26, 2020

(65) Prior Publication Data

US 2022/0225770 A1 Jul. 21, 2022

(30) Foreign Application Priority Data

May 20, 2019 (DE) ..... 10 2019 113 248.7

(51) Int. Cl.
*A47C 1/031* (2006.01)

(52) U.S. Cl.
CPC ..... *A47C 1/031* (2013.01)

(58) Field of Classification Search
CPC ..... A47C 1/031; A47C 1/032; A47C 1/03205; A47C 7/541; A47C 7/40
(Continued)

(56) References Cited

U.S. PATENT DOCUMENTS 7,093,904 B1 * 8/2006 McMillen ..... A47C 7/543 297/411.32
9,683,397 B2 6/2017 Buchholz
(Continued)

FOREIGN PATENT DOCUMENTS

DE 102011017301 A1 10/2012
DE 202017101471 U1 * 5/2017 ..... A47C 7/38
(Continued)

OTHER PUBLICATIONS

International Search Report dated Jun. 23, 2020 in related/corresponding International Application No. PCT/EP2020/063810.
(Continued)

*Primary Examiner* — Milton Nelson, Jr.
(74) *Attorney, Agent, or Firm* — PATENT PORTFOLIO BUILDERS PLLC

(57) ABSTRACT

A pivot fitting has a first lever mounted such that is pivotable out of a starting position about a force-transmitting shaft serving as an axis of rotation in relation to the shaft. The fitting has a clamping mechanism fixing the first lever in different angular positions relative to the shaft. The clamping mechanism has a toothed-ring disc positioned on the shaft and has an outer toothing structure formed on the outer periphery, a catch mounted in a pivotable manner on the first lever and is loaded in the direction of the outer toothing structure and, in a latching position, is in engagement with the outer toothing structure. A first control disc is mounted in a rotatable manner about the shaft so that following movement through the predetermined angle out of the starting position in an adjustment direction, the catch is disengaged from the outer toothing structure, and with the catch disengaged from the outer toothing structure it is possible for the first lever to be pivoted back relative to the shaft into the starting position.

18 Claims, 27 Drawing Sheets

Figure 1:
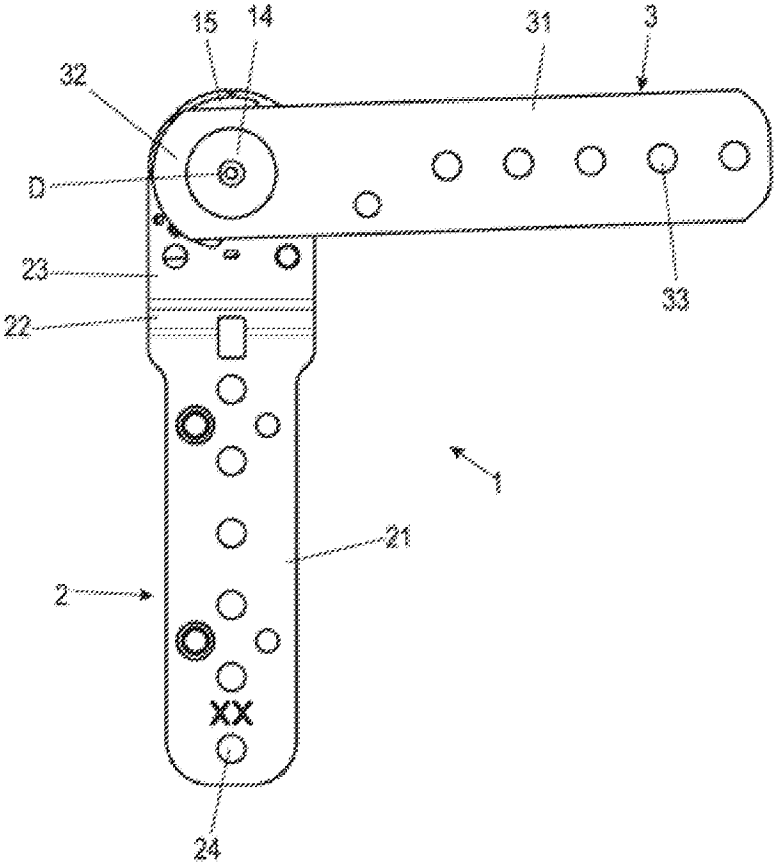

(58) Field of Classification Search
USPC ..... 297/411.32
See application file for complete search history.

(56) References Cited

U.S. PATENT DOCUMENTS

| | | | |
|---|---|---|---|
| 10,993,535 | B2 | 5/2021 | Nill et al. |
| 2021/0007488 | A1 | 1/2021 | Nill |

FOREIGN PATENT DOCUMENTS

| | | | | | |
|---|---|---|---|---|---|
| DE | 102017110246 | A1 | | 11/2018 | |
| DE | 102017110247 | A1 | | 11/2018 | |
| DE | 102017110248 | A1 | | 11/2018 | |
| DE | 102017110253 | A1 | | 11/2018 | |
| EP | 2526828 | A1 | * | 11/2012 | ..... A47C 1/027 |
| EP | 2805645 | A1 | | 11/2014 | |
| WO | 2017057759 | A1 | | 4/2017 | |
| WO | 2018206487 | A1 | | 11/2018 | |
| WO | WO-2018206360 | A1 | * | 11/2018 | ..... A47C 20/023 |

OTHER PUBLICATIONS

Search Report created Mar. 2, 2020 in related/corresponding DE Application No. 10 2019 113 248.7.
Written Opinion dated Jun. 23, 2020 in related/corresponding International Application No. PCT/EP2020/063810.
Office Action dated May 8, 2023 in related/corresponding IN Application No. 202147058340.

* cited by examiner

PIVOT FITTING AND PIECE OF FURNITURE

BACKGROUND AND SUMMARY OF THE INVENTION

Exemplary embodiments of the present invention relate to a pivot fitting, in particular for movable furniture parts on seating or reclining furniture, and to a piece of furniture.

A pivot fitting of the type is known, for example, from DE 10 2017 110 253 A1. In this pivot fitting, two levers can be fixed relative to each other by means of a clamping mechanism. One of these levers can be attached to a base body or seat part of an upholstered piece of furniture, while the second lever serves to fix a pivotably mounted headrest, armrest, footrest, or another furniture part pivotably mounted on the base body or seat part of the piece of furniture.

With the aid of the pivot fitting, the pivotable furniture part can be pivoted from an initial position into a predetermined pivot position and fixed in this pivot position.

The pivot fitting is designed in such a way that the furniture part to be adjusted can be moved from any pivot position without the two levers first having to be pivoted back into the initial position.

Such a pivot fitting has proven itself in practice.

The problem with such a pivot fitting is that if the pivot fitting is overloaded, damage to the pivot fitting or a furniture part can occur.

To prevent such damage, it is known, for example, from DE 10 2017 110 248 A1 to mount an overload clutch between the two levers of the pivot fitting, which is arranged as a structural unit between the first lever and the second lever.

The disadvantage here is that such overload clutches are relatively expensive to manufacture. Another disadvantage is that the overload clutch must be re-engaged at the point at which it is disengaged, or at least can only be re-engaged in a staggered grid.

Exemplary embodiments of the present invention are directed to further developing a pivot fitting of the generic type in such a way that the pivot fitting is also protected against an overload in a simple and inexpensive manner.

Exemplary embodiments of the invention are further directed to providing piece of furniture with which the operation of a piece of furniture with movable components is further improved.

The pivot fitting according to the invention comprises at least one first lever, which is mounted so as to be pivotable about a force-transmitting shaft serving as a pivot axis from an initial position through a predetermined angle thereto.

The pivot fitting further comprises a clamping mechanism for fixing the first lever in different angular positions within the predetermined angle relative to the force-transmitting shaft.

This clamping mechanism has a toothed-ring disc fitted onto the force-transmitting shaft with outer toothing structure formed on the outer edge, and a catch pivotably mounted on the first lever, is loaded in the direction of the outer toothing structure and is in engagement with the outer toothing structure of the toothed-ring disc in a latching position.

The clamping mechanism further comprises a first control disc rotatably mounted about the force-transmitting shaft and by means of which the at least one catch can be disengaged from the toothing in an adjustment direction after passing over the predetermined angle from the normal position, so that, when the catch is disengaged from the toothing, the first lever can be pivoted back into the normal position relative to the force-transmitting shaft by passing over the predetermined angle in a return direction.

At least one friction disc arranged on the force-transmitting shaft in a rotationally fixed and axially secured manner is pushed onto the toothed-ring disc, wherein the toothed-ring disc is retained on the at least one friction disc in a frictionally locking manner up to a predetermined torque against rotation about the axis of rotation.

With a pivot fitting designed in this manner, an overload safety device is made possible that is easy to install and inexpensive in its components, with which the force-transmitting shaft is decoupled from the toothed-ring disc and thus the force-transmitting shaft is decoupled from the first lever in the event of an overload.

This allows the first lever to be pivoted relative to the force-transmitting shaft without damaging the clamping mechanism.

If the overload is again undershot, the pivot fitting according to the invention is still fully functional.

According to an advantageous embodiment variant of the invention, an inner circumferential edge of the toothed-ring disc is conically shaped and slid onto a cone arranged on the force-transmitting shaft.

In this case, the at least one friction disc is in pressing contact with the toothed-ring disc on the side of the smaller diameter of the inner circumferential edge of the toothed-ring disc.

Due to the cone arranged on the force-transmitting shaft and the friction disc, the friction disc arranged on the force-transmitting shaft in a rotationally fixed manner and the toothed-ring disc are pressed against each other in such a way that the predetermined torque defining the limit for overload must be exceeded in order to rotate the friction disc relative to the toothed ring disc.

Friction is created on the cone and on the contact surface of the toothed-ring disc by the resilient contact force of the friction disc.

Depending on the selected contact pressure or friction value between the contact surface of the toothed-ring disc on the friction disc as well as the predefined cone angle, the predetermined torque can be defined.

According to an advantageous further development of the invention, the cone is integrally formed on the force-transmitting shaft, which enables extremely simple assembly.

According to an alternative embodiment variant, the cone is mounted on the force-transmitting shaft.

This means that the force-transmitting shaft itself and the cone, which is to be manufactured as an individual component, for example as a sheet metal element, can be produced very cost-effectively.

According to an advantageous further development, the cone is formed as a radially slotted clamping ring.

According to an advantageous embodiment variant, the cone angle of the cone is between 15° and 35°, particularly preferably between 20° and 30°.

According to an alternative embodiment variant, a friction disc is slid on both sides of the toothed-ring disc in a rotationally fixed and axially secured arrangement.

Accordingly, this variant does not require a cone on the force-transmitting shaft.

According to an alternative embodiment variant, a plurality of toothed-ring discs are placed on the force-transmitting shaft, with a friction disc held non-rotatably on the force-transmitting shaft being arranged between two toothed-ring discs.

Preferably, three toothed-ring discs and two friction discs arranged therebetween are used.

In an alternative embodiment variant, two toothed-ring discs are used with a friction disc arranged between them.

As a result of the force exerted by the friction discs fitted and/or pressed onto the force-transmitting shaft in a rotationally fixed manner, friction is thus generated at six contact points (in the case of three toothed-ring discs) or four contact points (in the case of two toothed-ring discs fitted), via which the torque provided for the overload protection can be adjusted.

The wear and the overload torque can be easily adjusted by means of the spring force and pressure depth of the friction discs used and the number of toothed-ring discs used.

According to a further advantageous embodiment variant, a tab is integrally formed on the first control disc that extends perpendicularly to the plane of the first control disc axially outwardly relative to the force-transmitting shaft into a recess provided for this purpose in a cutout of the first lever.

According to a further embodiment variant, a recess is formed on an outer edge of the friction disc, in which a changeover element is accommodated such that it can be pivoted through a changeover angle in the plane of the friction disc.

This changeover element also serves as an alternative to the combination of the control pin arranged on the first lever and the cutout in the first control disc.

The friction disc accommodating the changeover element has a thickness, in the axial direction of the force-transmitting shaft, which is greater than the thickness of the changeover element.

This is a simple way of ensuring that the forces applied by the friction discs cannot cause this changeover element to jam.

According to a preferred embodiment variant, the at least one friction disc is pressed onto the force-transmitting shaft against the toothed-ring disc with an interference fit.

This makes it possible to generate sufficient friction between the friction disc and the toothed-ring disc by means of the friction disc alone.

According to a further advantageous embodiment variant, the friction disc is designed as a disc spring.

According to a further preferred embodiment variant, a changeover contour is formed on an outer edge of the friction disc.

According to a further advantageous further development, the predetermined torque up to which the toothed-ring disc is frictionally held against rotation about the axis by the at least one friction disc is at least 70 Nm, preferably at least 80 Nm.

This ensures that at lower loads, where there is no risk of damage to the pivot fitting, the clamping mechanism does not react to lower torques, so that the levers remain in their position and can only be adjusted against each other from the predetermined torque, without using the actual function of the clamping mechanism.

A particular advantage arises in the arrangement according to the invention in that the pivot fitting allows a maximum angle of adjustment of approximately 250°. This is made possible by the arrangement of the control pins and the stops as well as the internal structure with the toothed-ring disc, the control disc and the catch.

According to one embodiment variant, a second lever is coupled in a rotationally fixed manner to the force-transmitting shaft.

The piece of furniture according to the invention is characterized by a pivot fitting as described above.

According to one embodiment variant, the second lever is part of the adjustable furniture part.

BRIEF DESCRIPTION OF THE DRAWING FIGURES

Figure 2:
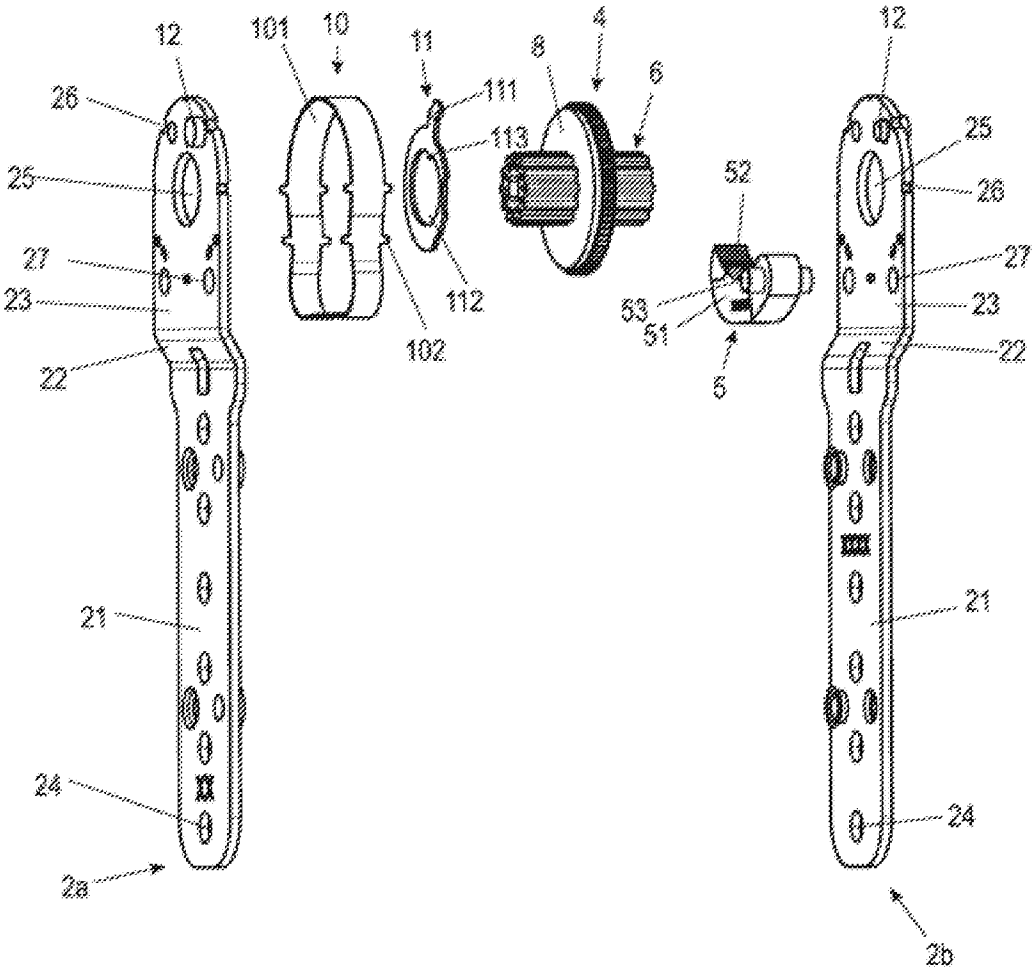
Figure 3:
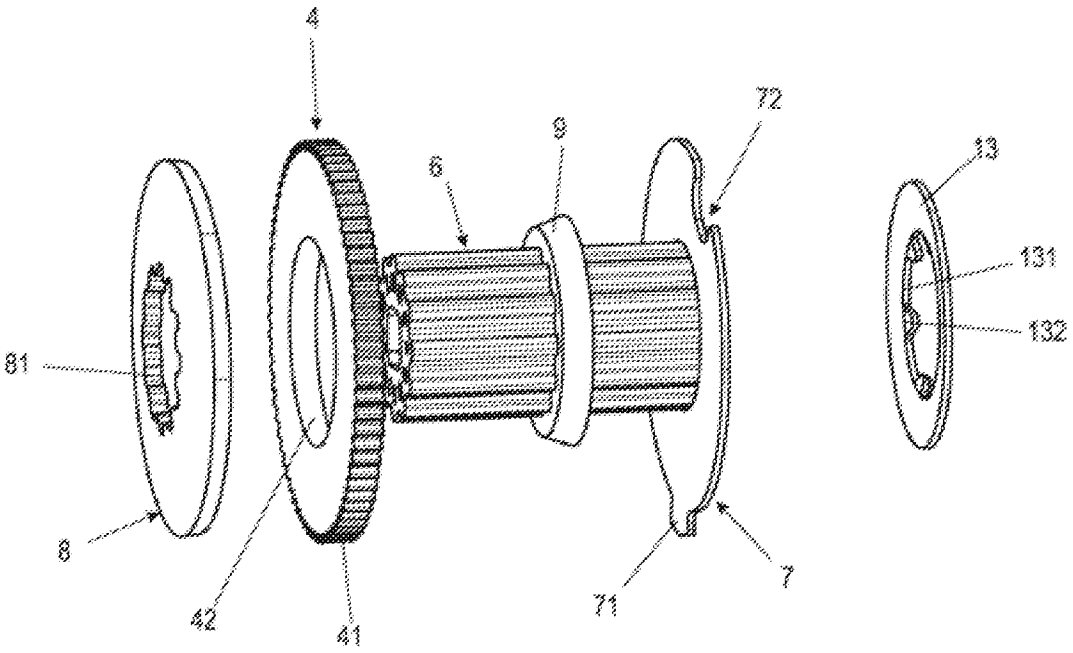
Figure 4:
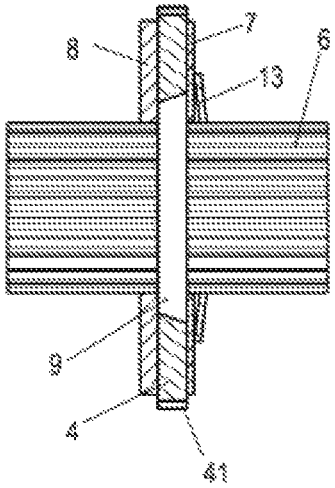
Figure 5:
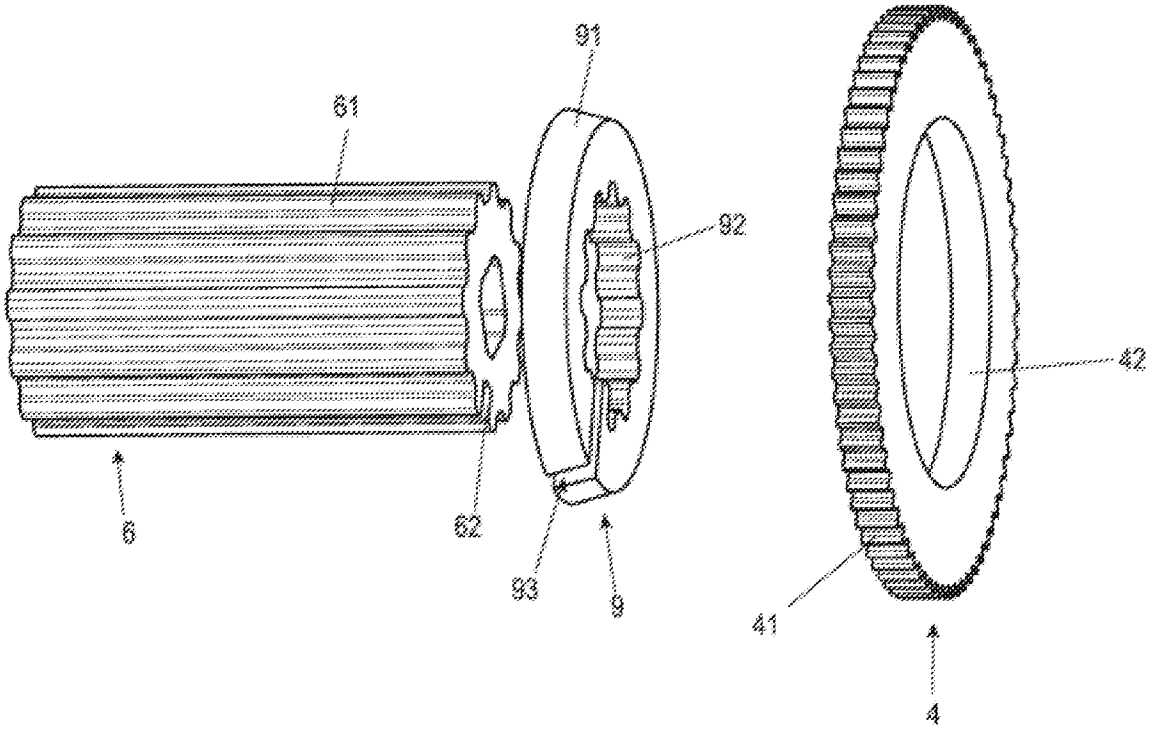
Figure 6:
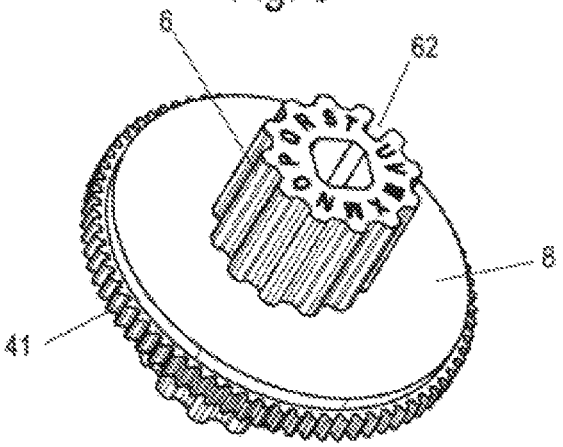
Figure 7:
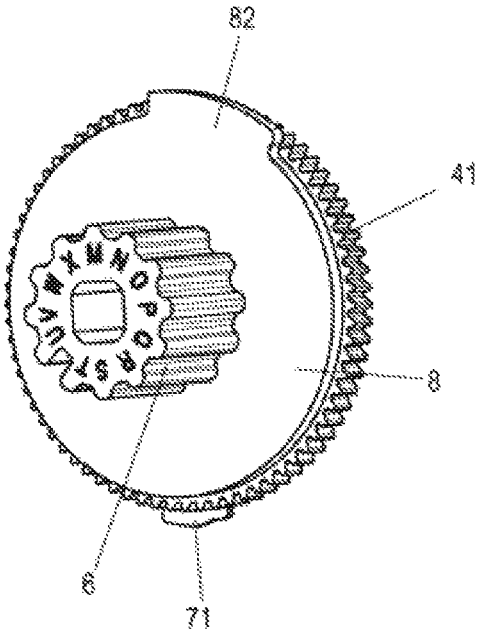
Figure 8:
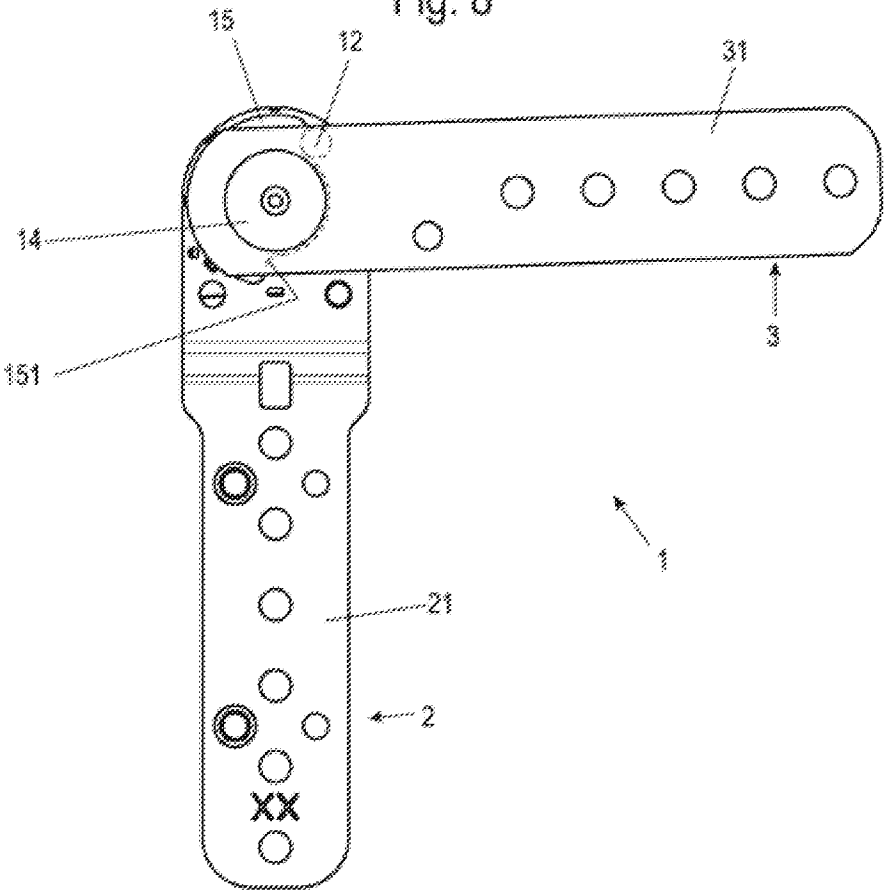
Figure 9:
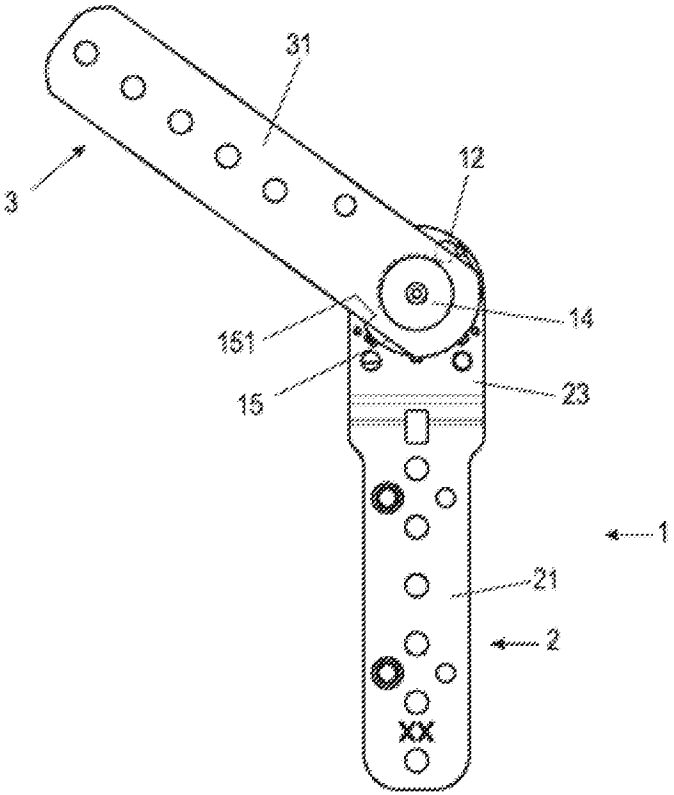
Figure 10:
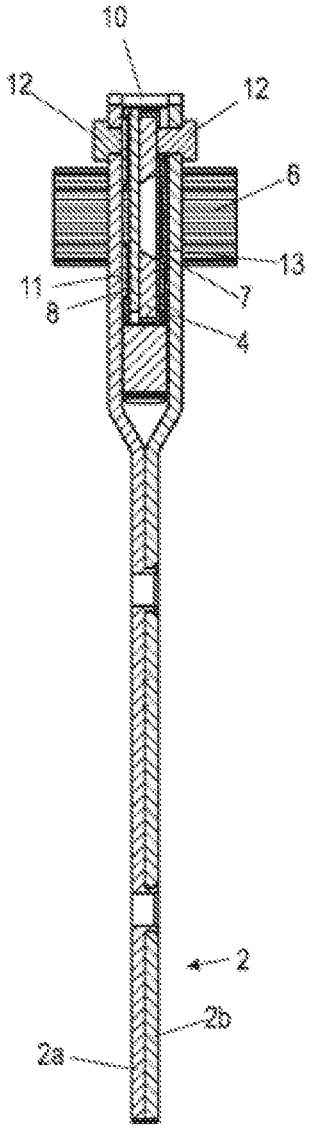
Figure 11:
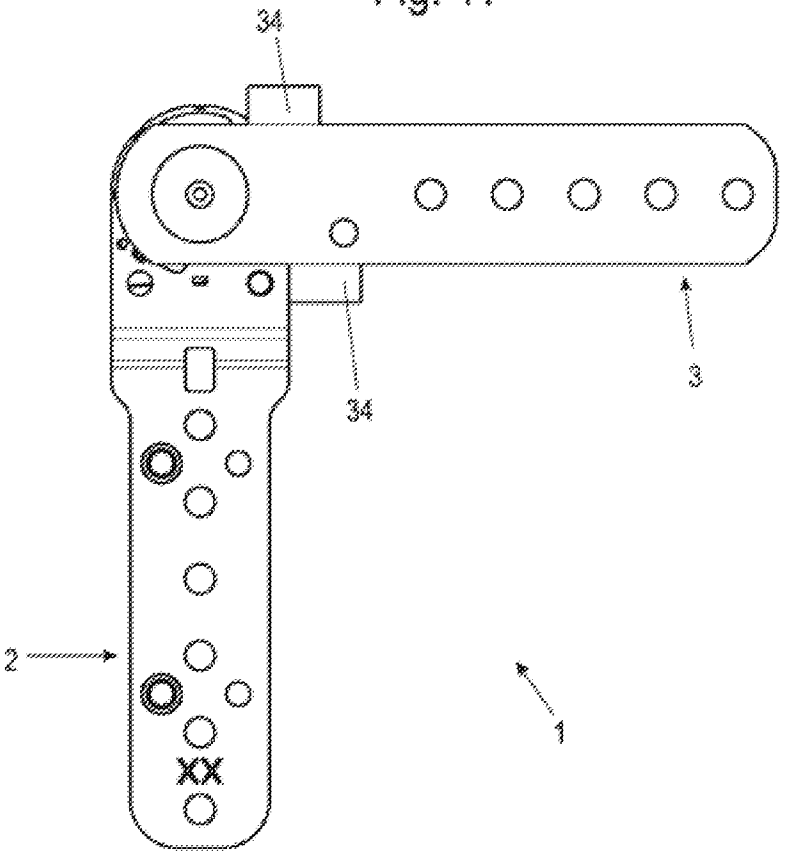
Figure 12:
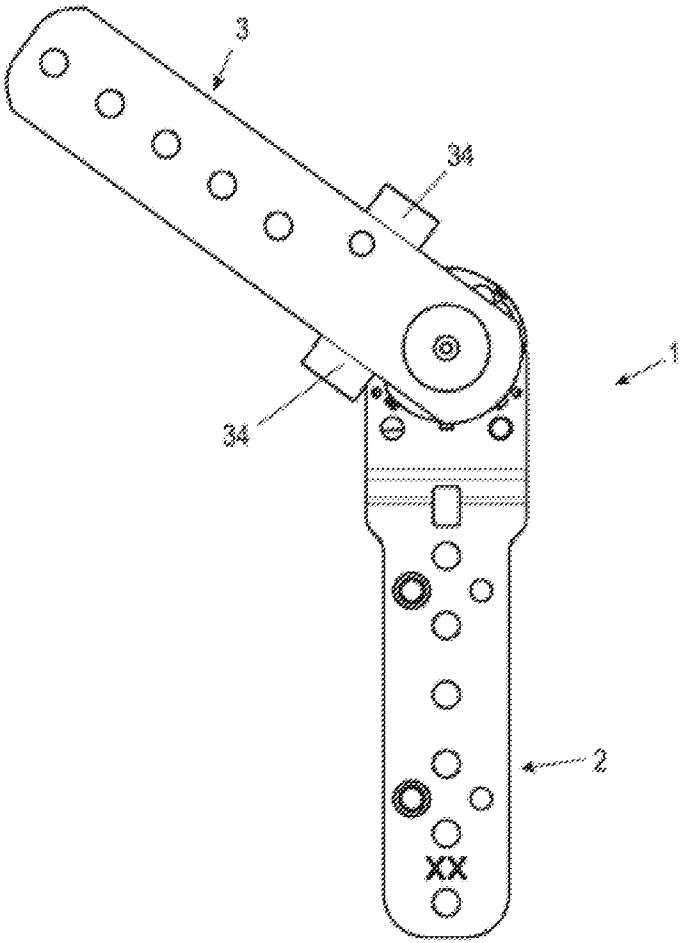
Figure 13:
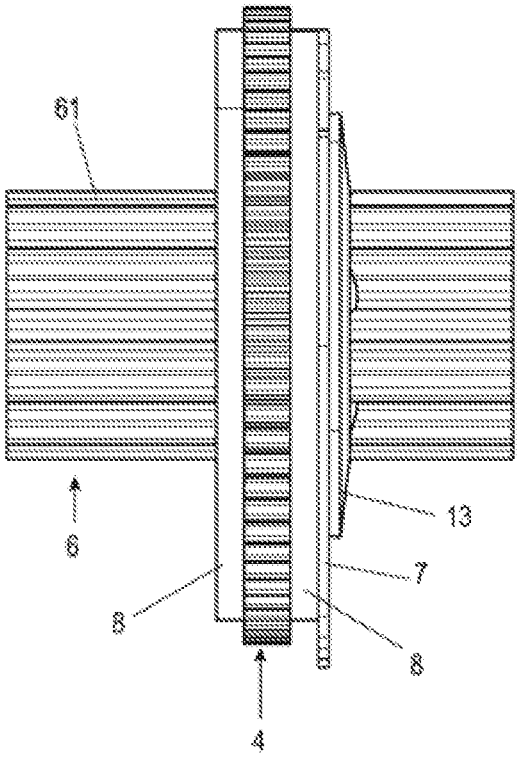
Figure 20:
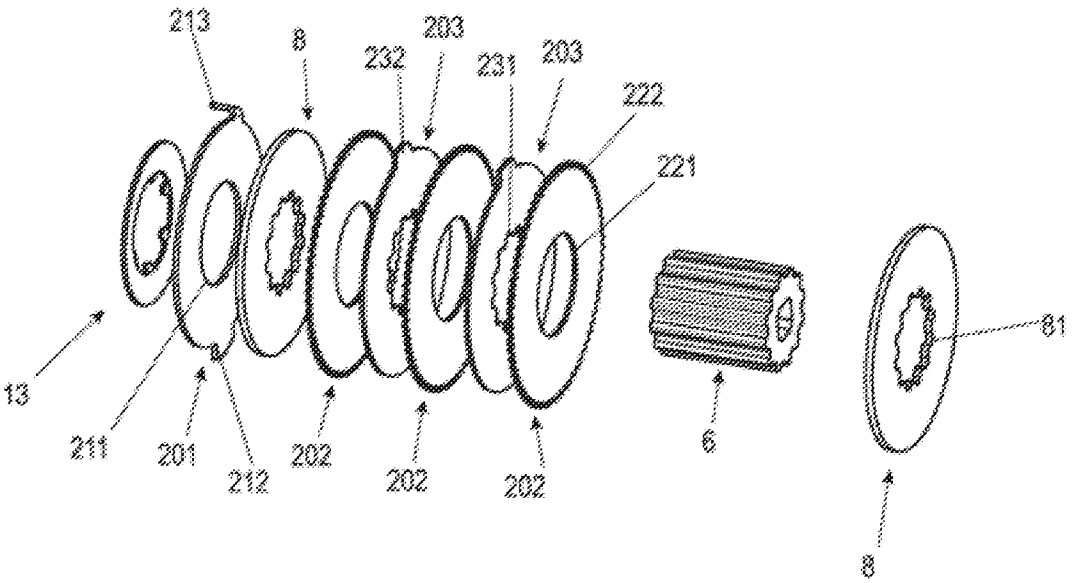
Figure 21:
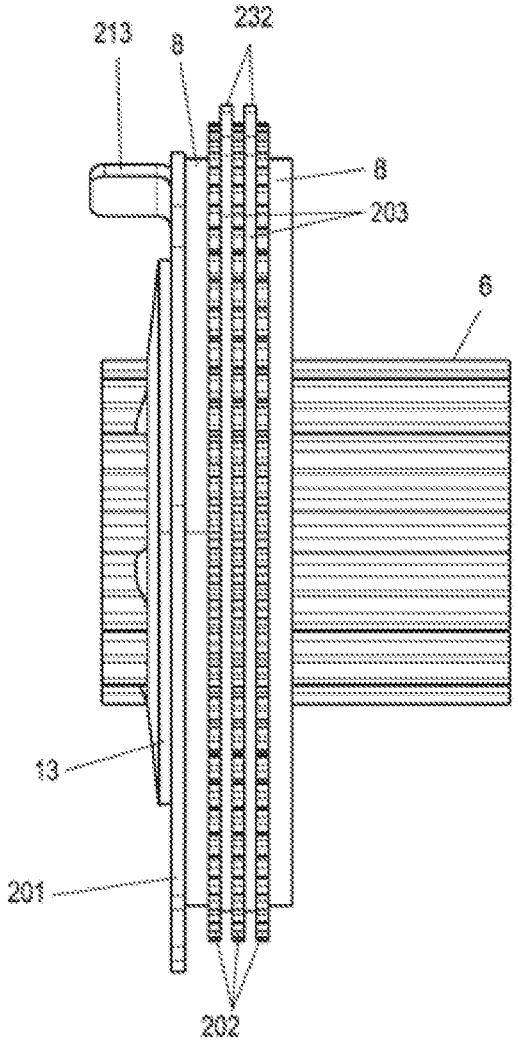
Figure 22:
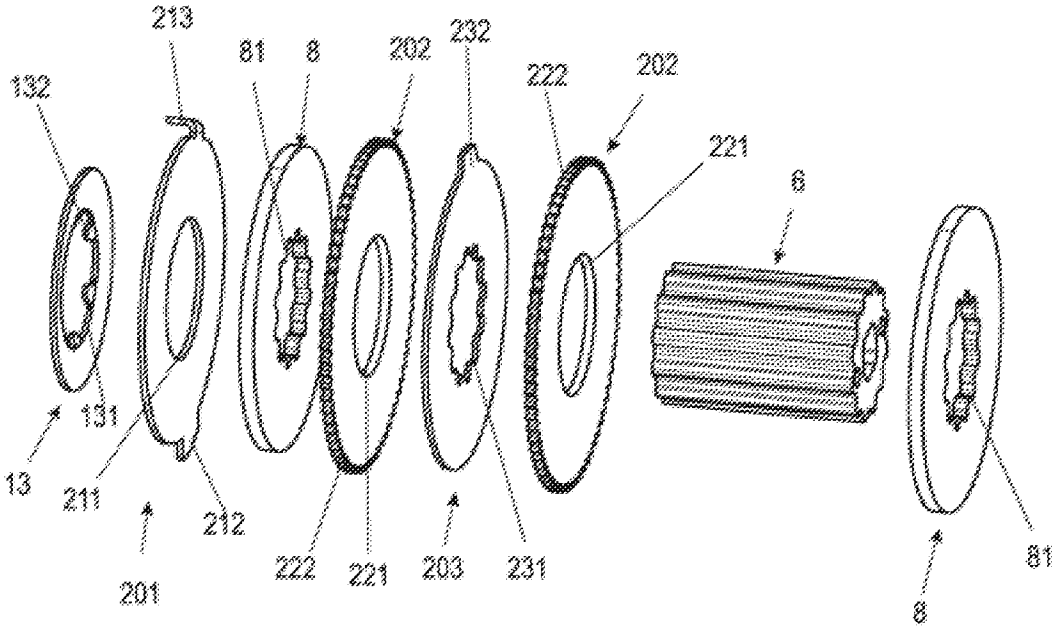
Figure 23:
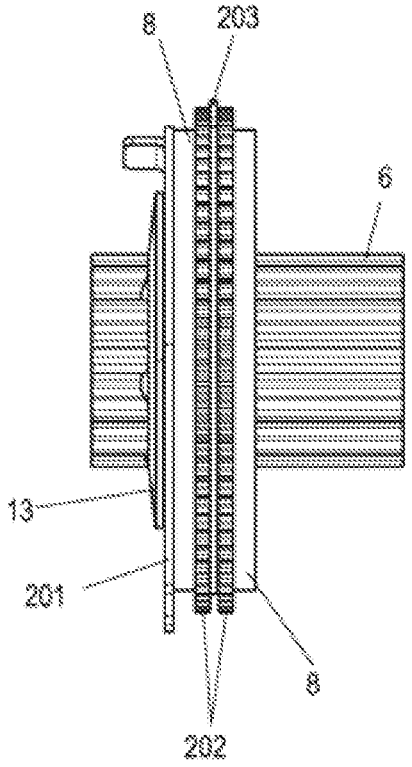
Figure 24:
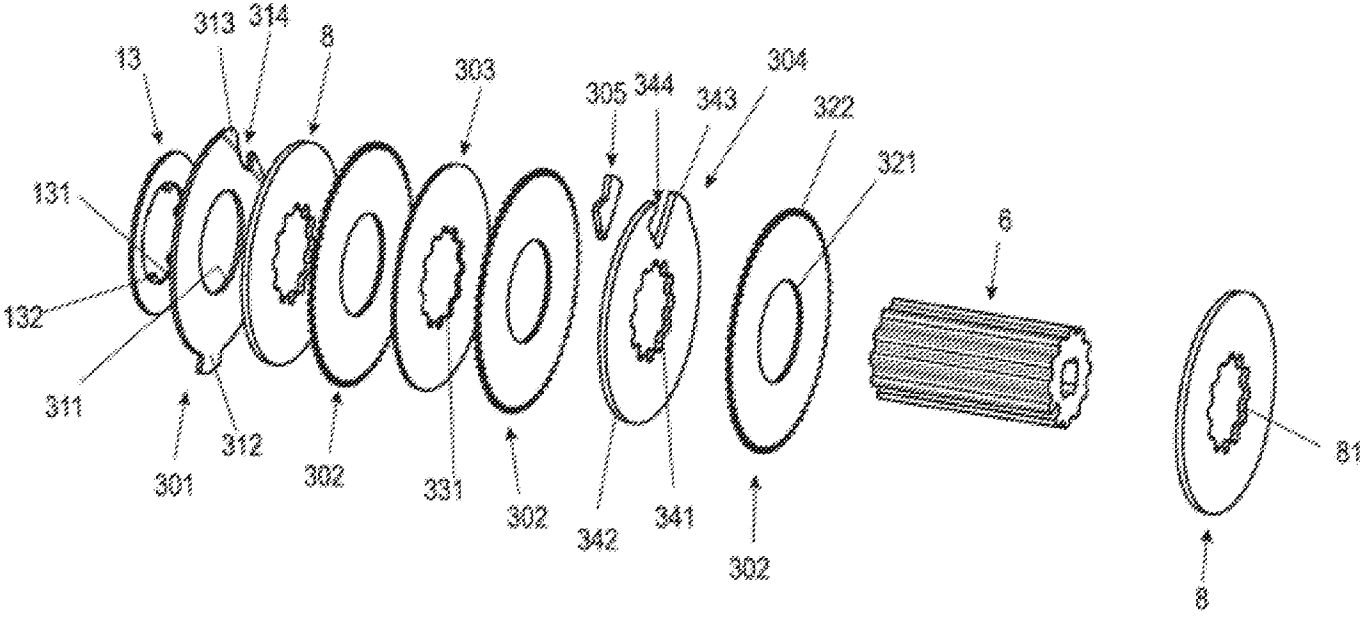
Figure 25:
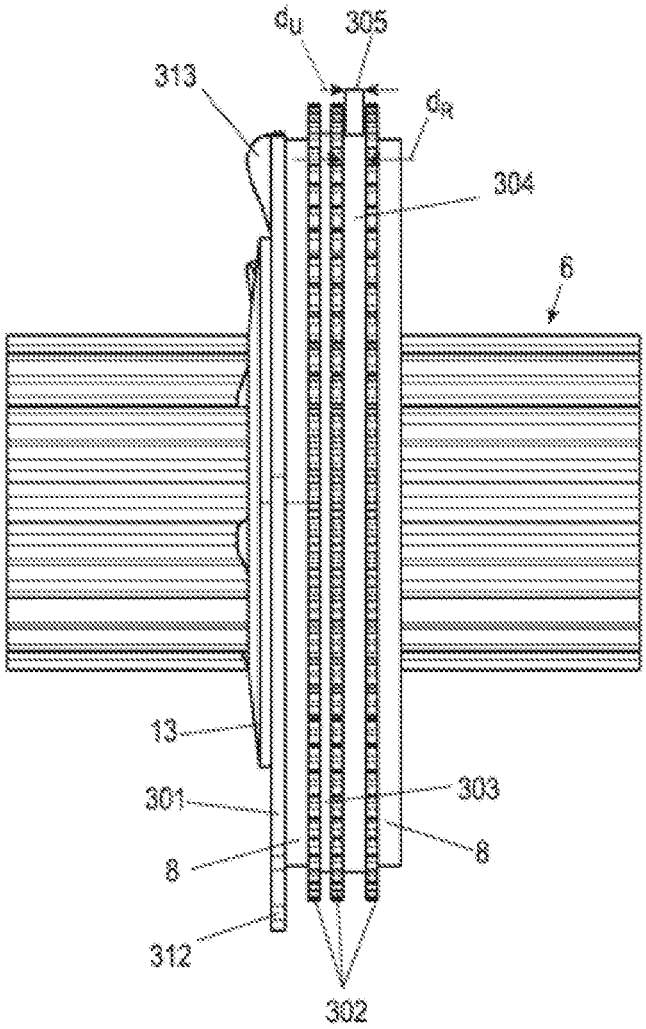
Figure 26:
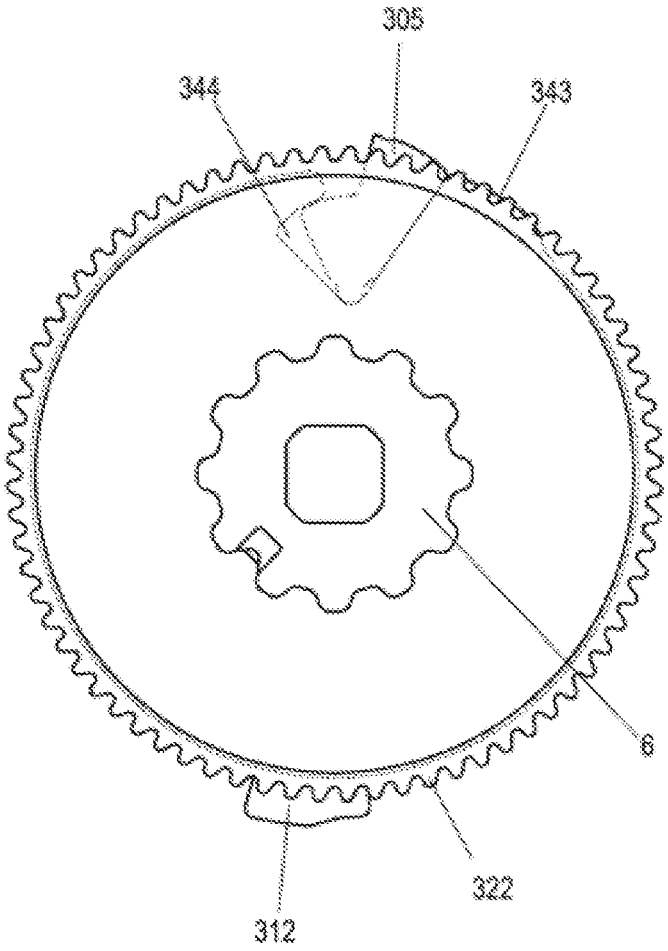
Figure 27:
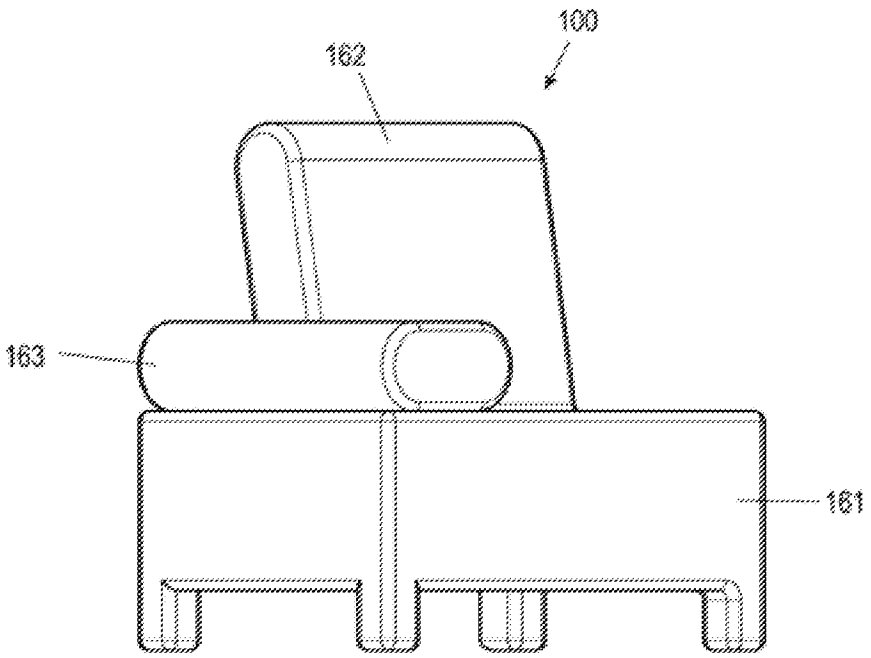
Figure 28:
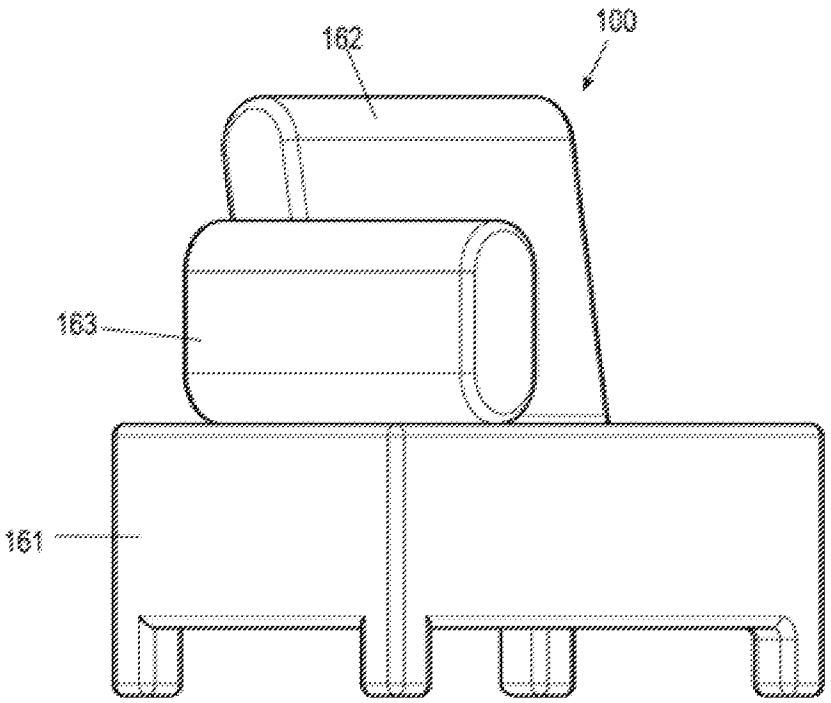

Preferred embodiment variants are described in more detail below with reference to the accompanying drawings, wherein:

FIG. 1 shows a top view of an embodiment variant of a pivot fitting according to the invention, FIG. 2 shows a perspective exploded view of the pivot fitting without representation of the second lever, FIG. 3 shows an individual perspective view of the toothed-ring disc, the force-transmitting shaft, the friction disc, the cone and the first control disc, FIG. 4 shows a partial sectional view of the force-transmitting shaft with overload components arranged on it, FIG. 5 shows an exploded view of an embodiment variant of the toothed-ring disc, the cone and the force-transmitting shaft, FIG. 6 shows a perspective view of the components shown in FIG. 5 in the assembled state, FIG. 7 shows a perspective view of an alternative embodiment variant of a friction disc mounted on the force-transmitting shaft, FIG. 8 shows a top view of the pivot fitting showing a stop, FIG. 9 shows a representation of the pivot fitting corresponding to FIG. 8 in another pivot position, FIG. 10 shows sectional view of the pivot fitting, FIGS. 11 and 12 show top views of the pivot fitting with alternatively designed stops on the second lever, FIG. 13 shows a side view of an alternative embodiment configuration of the overload protection, FIGS. 14 to 19 show top views of the pivot fitting with the lever head omitted to illustrate the functional sequence of a pivoting and changeover movement, FIG. 20 shows a perspective exploded view of an alternative embodiment variant of a clamping mechanism with overload protection with three toothed-ring discs and friction discs arranged between them, FIG. 21 shows a side view of the embodiment configuration shown in FIG. 20, FIG. 22 shows a perspective exploded view of a further alternative embodiment variant of a clamping mechanism with overload protection with two toothed-ring discs and friction discs arranged therebetween, FIG. 23 shows a side view of the embodiment configuration shown in FIG. 22, FIG. 24 shows a perspective exploded view of a further alternative embodiment variant of a clamping mechanism with overload protection with three toothed-ring discs and friction discs arranged therebetween and an alternative changeover element, FIG. 25 shows a side view of the embodiment configuration shown in FIG. 24, FIG. 26 shows a schematic top view of the embodiment configuration shown in FIG. 24 to illustrate the arrangement of the changeover element, and FIGS. 27 and 28 show schematic representations of a piece of furniture with a pivotable furniture part arranged thereon.

DETAILED DESCRIPTION

In the following figure description, terms such as top, bottom, left, right, front, rear, etc. refer exclusively to the exemplary representation and position of the pivot fitting, lever, toothed-ring disc, catch, force-transmitting shaft, cone, friction disc and the like selected in the respective figures. These terms are not to be understood restrictively, i.e., due to different working positions or the mirror symmetrical design or the like, these references may change.

In FIG. 1, the reference sign 1 altogether denotes an embodiment variant of a pivot fitting according to the invention.

Such a pivot fitting 1 serves in particular to enable a pivoting movement of movable furniture parts on pieces of furniture, such as for example an armrest 103 or a backrest 102, headrest or footrest of a piece of furniture 100 designed as a piece of seating or reclining furniture, as shown by way of example in FIGS. 27 and 28.

As shown in FIG. 1, in the embodiment variant shown here, the pivot fitting 1 has a first lever 2 and a second lever 3. The two levers 2, 3 are mounted so as to be pivotable relative to one another about a pivot axis D from an initial position through a predetermined angle in an adjustment direction V and a return direction R.

A clamping mechanism of the pivot fitting 1 arranged here between two lever heads 23*a* and 23*b* of the first lever 2 is designed in such a way that the two levers 2, 3 can be fixed in different angular positions within the predetermined angle relative to each other against a torque acting in the return direction R and can be pivoted in the return direction R when the clamping mechanism is deactivated.

This allows, for example, the adjustment of the armrest 103 of the piece of furniture 100, in which the armrest 103 is connected to the second lever 3 while the first lever 2 is connected to the body 101 of the furniture, so as to pivot the armrest 103 to a position that is comfortable for the user and to latch it in the pre-desired position.

As shown in FIGS. 2 and 3, the clamping mechanism comprises a force-transmitting shaft 6 coupled to the second lever 3 in a rotationally fixed manner.

A toothed-ring disc 4 having outer toothing structure 41 formed on the outer edge is placed on this force-transmitting shaft 6.

It is also conceivable to design the pivot fitting 1 without a second lever 3.

The clamping mechanism acts between the lever 2 and the force-transmitting shaft 6, thus allowing an angular adjustment between the lever 2 and the force-transmitting shaft 6.

If the pivot fitting 1 comprises a second lever 3 mounted on the force-transmitting shaft 6, the clamping mechanism thus also allows an angular adjustment between the first lever 2 and the second lever 3.

It is expressly noted that the second lever 3 can also be part of a piece of furniture that is placed directly on the force-transmitting shaft 6.

The shape of the lever 3 may therefore differ significantly from the flat and elongated shape shown in the figures, for example the use of tubes, in particular rectangular or square tubes, is also conceivable.

Furthermore, a catch 5 loaded by a spring element 10 in the direction of this outer toothing structure 41 of the toothed-ring disc 4 is pivotably mounted on the first lever 2. The catch 5 is thereby in engagement with this outer toothing structure 41 in a latching position.

Furthermore, the clamping mechanism comprises a first control disc 7, which is rotatably mounted about the common axis D and by means of which the catch 5 can be disengaged from the outer toothing structure 41 of the toothed-ring disc 4 after passing the predetermined angle from the initial position in an adjustment direction V.

In this out-of-engagement position, the second lever 3 can be pivoted back to the initial position relative to the first lever 2 by passing over the predetermined angle in a return direction R.

As further shown in FIGS. 2 to 4, at least one friction disc 8, which is pushed onto the force-transmitting shaft 6 in a rotationally fixed and axially secured manner, is slid onto the toothed-ring disc 4.

The toothed-ring disc 4 is frictionally held on the at least one friction disc 8 against rotation about the axis D up to a predetermined torque M.

Frictionally retaining the toothed-ring disc 4 relative to the force-transmitting shaft 6 up to a predetermined torque M thus represents a cost-effective overload safety device for such a pivot fitting 1, which is less of a build-up compared to an overload safety device designed as a separate structural unit.

As shown in FIGS. 3 to 5, according to a preferred embodiment variant, an inner circumferential edge 42 of the toothed-ring disc 4 is pushed onto a cone 9 arranged on the force-transmitting shaft 6 in a conical shape. In this case, the one friction disc 8 is in pressing contact with the toothed-ring disc 4 on the side of the smaller diameter of the inner circumferential edge 42 of the toothed-ring disc 4.

In one embodiment variant, the cone 9 may be integrally formed directly on the force-transmitting shaft 6.

According to an alternative preferred embodiment variant, the cone 9 is mounted on the force-transmitting shaft 6.

In particular, the cone 9 is designed as a radially slotted clamping ring, as shown in FIG. 5. The cone 9 shown there has an internally toothed inner diameter 92, for rotationally fixed attachment to the force-transmitting shaft 6 provided with an outer toothing structure 61.

The outer circumferential edge 91 of the cone 9 is conically shaped.

For easier application of the cone 9 to the force-transmitting shaft 6, the cone 9 shown in FIG. 5 is formed with a slot 93. When the friction disc 8 is pressed onto the cone 9, the internal toothing structure of the cone 9 is pressed onto the outer toothing structure of the force-transmitting shaft 6, so that the cone 9 is axially clamped on the force-transmitting shaft 6.

Preferably, the cone angle of the outer circumferential edge 91 of the cone 9 is between 15° and 35°. Particularly preferably, the cone angle is between 20° and 30°.

The friction disc 8 is preferably pressed onto the force-transmitting shaft 6 against the toothed-ring disc 4 with an interference fit.

Alternatively, other axial fixations of the friction disc 8 are conceivable, for example by applying a weld seam, a nut, or the like.

As an alternative to mounting the toothed-ring disc 4 via a cone 9 shown in FIGS. 3 to 5, it is also conceivable to slide such a friction disc 8 onto the force-transmitting shaft 6 on both sides of the toothed-ring disc 4.

This also allows a sufficiently large friction between the friction discs 8 and the toothed-ring disc 4 to ensure the function of an overload protection.

As further shown in FIG. 3, the at least one friction disc 8 is preferably designed as a disc spring.

The predetermined torque M, up to which the toothed-ring disc 4 is frictionally held against rotation about the axis D by the at least one friction disc 8, is preferably at least 70 Nm, particularly preferably at least 80 Nm.

As further shown in FIG. 3, the first control disc 7 is placed on the force-transmitting shaft 6 on the side of the toothed-ring disc 4 facing away from the friction disc 8.

The first control disc 7 can be pivoted relative to the force-transmitting shaft 6 and is secured axially by a disc-spring-like spring element 13.

The spring element 13 is thereby secured against rotation by teeth 132 on an inner circumference 131 of the spring element 13 on the force-transmitting shaft 6.

As shown in FIG. 2, the second control disc 11 is arranged on the side of the friction disc 8 facing away from the toothed-ring disc 4 on the force-transmitting shaft 6. The second control disc 11 has a switching arm 111 and an elongated hole 112. A single tooth 113 engages the outer toothing structure of the force-transmitting shaft 6.

As shown in FIG. 7, in place of the second control disc 11, it is also conceivable to form on the friction disc 8 a changeover contour 82 which extends radially outwardly from the circumferential edge of the friction disc 8 through a predetermined angle.

The catch 5 has a plurality of teeth 52 at a first end of a catch arm 51, which engage in use with the outer toothing structure 41 of the toothed-ring disc 4.

At the opposite end of the catch arm 51, pivot pins 53 protrude on both sides, with which the catch is pivotably fixed to pivot pin receptacles 27 of the lever heads 23 of the first cover 2*a* and the second cover 2*b*.

On the side of the catch arm 51 facing the outer toothing structure 41 of the toothed-ring disc 4 in the assembled position, a recess 54 is formed between the toothing 52 and the pivot pin 53 for accommodating the changeover contour 71 of the first control disc 7.

For limiting the pivoting angle between the two levers 2, 3, control pins 12 are fixed or integrally formed on the covers 2*a*, 2*b* of the first lever 2, which in the embodiment variant shown in FIGS. 8 and 9 strike in respective end positions against stop edges of a disc-shaped stop 15, wherein the disc-shaped stop 15 is connected in a rotationally fixed manner to the second lever 3 or the force-transmitting shaft 6.

In an alternative embodiment variant, these stops are formed by lateral stops 34 on the second lever 3, as shown in FIGS. 11 and 12.

The function of the pivot fitting 1 in normal operation is described below with reference to FIGS. 14 to 19.

Figure 14:
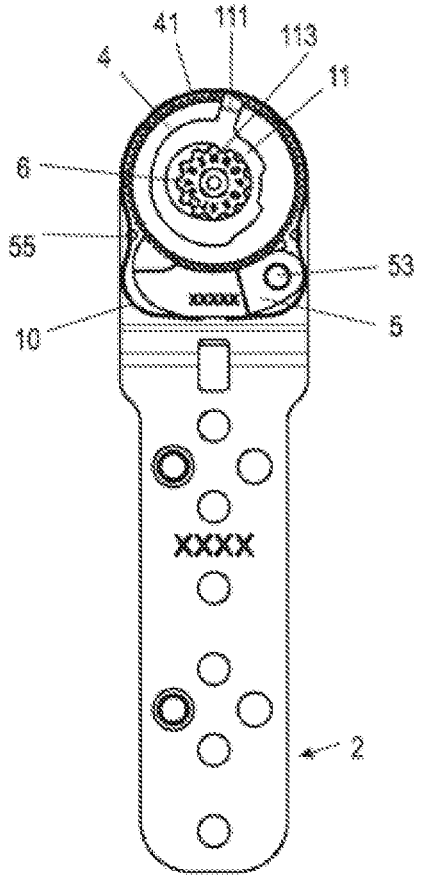

In FIG. 14, an exemplary position of the pivot fitting 1 is shown that has already been pivoted slightly in the adjustment direction V, in which the catch 5 engages in the outer toothing structure 41 of the toothed-ring disc 4.

Figure 15:
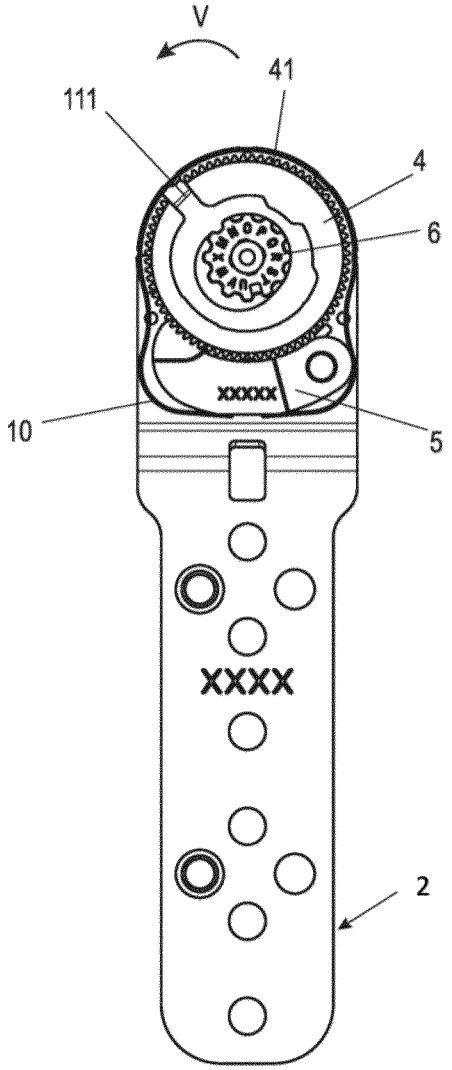

FIG. 15 shows a position of the pivot fitting 1 pivoted further in the adjustment direction V.

Here, the catch 5 is always pressed against the outer toothing structure 41 of the toothed-ring disc 4 by the spring element 10, which is in the form of a spring plate. The alignment of the outer toothing structure 41 of the toothed-ring disc 4 and the teeth 52 of the catch 5 is such that, in the adjustment direction V, the catch 5 can be displaced tooth by tooth of the outer toothing structure 41 of the toothed-ring disc 4.

Figure 16:
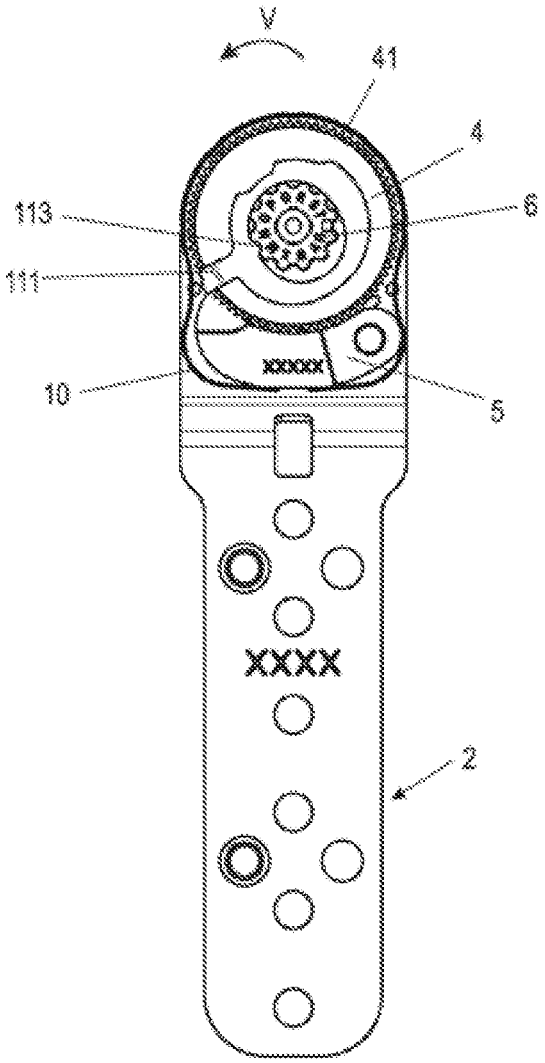

In the position shown in FIG. 16, the switching arm 111 of the second control disc 11 has reached the outermost tooth of the toothing of the catch 5.

The outermost tooth 52 is thereby formed with a run-up chamfer 55. As a result, upon further rotation of the force-transmitting shaft 6 and thus of the second lever 3 in the adjustment direction V, the switching arm 111 can be pushed onto the outer teeth 52 of the catch 5, whereby the teeth 52 of the catch 5 disengage from the outer toothing structure 41 of the toothed-ring disc 4, as shown in FIG. 17.

Figure 17:
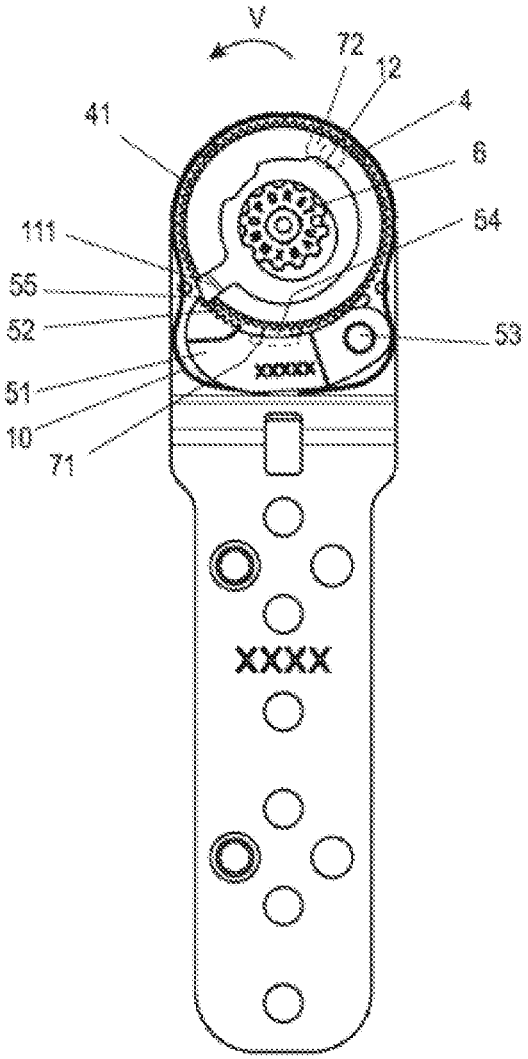
Figure 18:
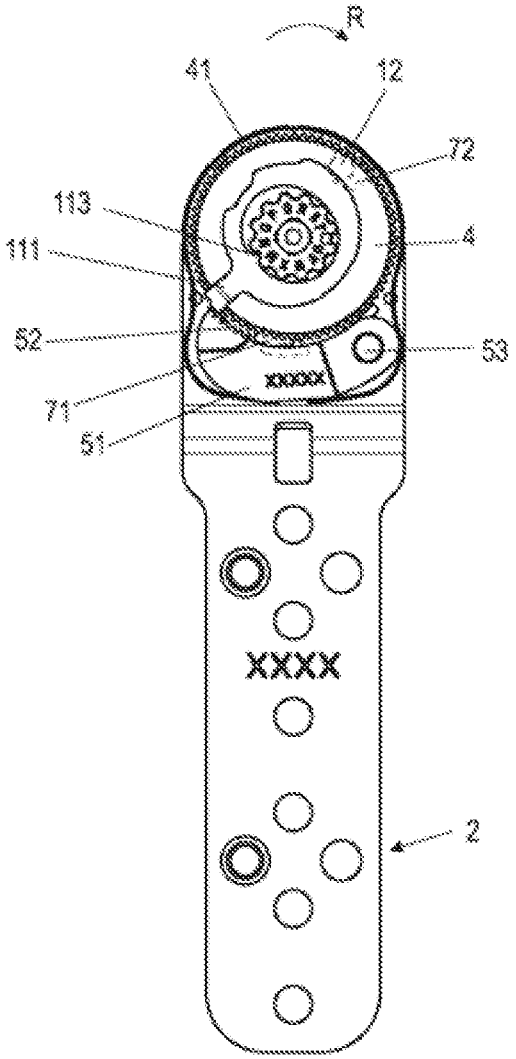
Figure 19:
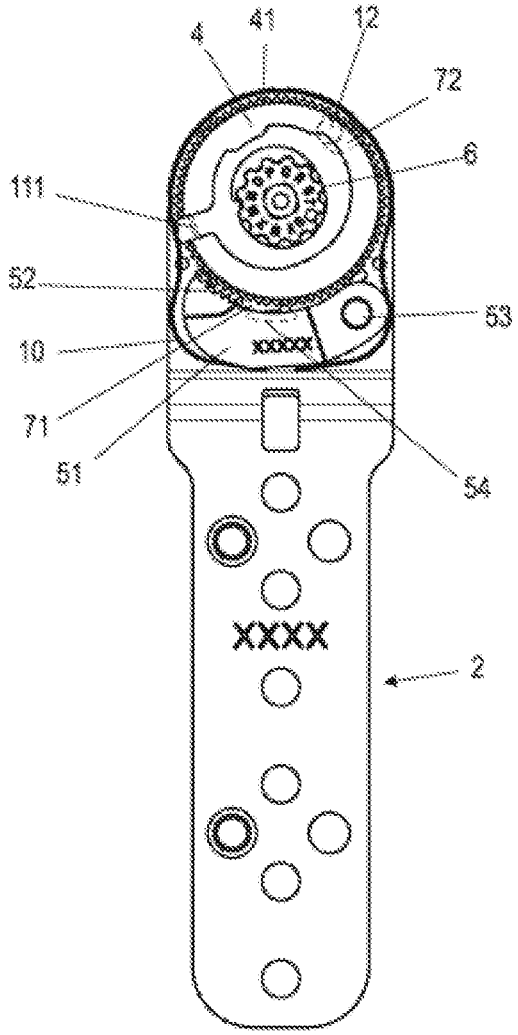

As further shown by dashed lines in FIG. 17, in this position, the changeover contour 71 of the first control disc 7 is engaged in the recess 54 of the catch 5.

Furthermore, the control pin 12 rests in the recess 72 of the first control disc 7 at the right edge of this recess 72.

If the second lever 3 or the force-transmitting shaft 6 is now moved in the opposite direction, i.e., in the return direction R, this causes the second control disc 11 to be pivoted about the switching arm 111 currently fixed on the teeth 52 of the catch 5 by the engagement of the control tooth 113 on the inner circumference of the second control disc 11 by the force-transmitting shaft 6 in the elongated hole 112 in the center of the second control disc 11.

At the same time, during this rotation of the force-transmitting shaft 6 in the return direction, the control pin 12 reaches the left edge of the recess 72 of the first control disc 7.

During the subsequent further rotation of the force-transmitting shaft 6 in the return direction R, the changeover contour 71 of the first control disc 7 is pushed onto a toothless plane of the arm 51 of the catch 5, so that the teeth 52 of the catch 5 remain out of engagement with the outer toothing structure 41 of the toothed-ring discs 4 and the pivot fitting 1 can thus be pivoted back into the initial position.

In the event of an overload acting on the pivot fitting 1, the function of the overload protection is such that, in the case or any pivot position or the levers 2, 3 of the pivot fitting 1 relative to one another, from a torque M caused by the friction between the friction disc 8 and the toothed-ring disc 4, the toothed-ring disc 4 begins to slip relative to the friction disc 8 about the axis of rotation D and the two levers 2, 3 can thus be pivoted relative to one another, as long as the force exerted on the levers is greater than the predetermined torque M.

If the force exerted on the levers decreases and falls below the predetermined torque M, the frictional adhesion between the friction disc 8 and the toothed-ring disc 4 resumes, so that the normal function of the pivot fitting 1 resumes.

In the alternative embodiment variants of a pivot fitting according to the invention shown in FIGS. 20 to 26, the clamping mechanism has a plurality of toothed-ring discs 202, 302 arranged side by side on the force-transmitting shaft 6 instead of the one toothed-ring disc 4.

A friction disc 203, 303, 304, which is held in a rotationally fixed manner on the force-transmitting shaft 6, is arranged between each of two such toothed-ring discs 202, 302.

In the embodiment variant shown in FIGS. 20 and 21, three such toothed-ring discs 202 are provided.

Each of these toothed-ring discs 202, 302 has an annular inner circumferential edge 221, 321 and an outer toothing structure 222, 322 in which the catch 5 engages.

In both the embodiment variants shown in FIGS. 20 and 21 and the embodiment variants shown in FIGS. 22 and 23 and FIGS. 24 to 26, the friction discs 8 rest against the outer surfaces of the outer toothed-ring discs 202, 302, pressing in the axial direction against the toothed-ring discs 202, 302.

Analogous to the embodiment variant shown in FIG. 13, a first control disc 201, 301 is slid onto the force-transmitting shaft 6 on an outer side of one of the friction discs 8.

This first control disc 201, 301 also has an annular inner circumferential edge 211.

Extending from an outer circumferential edge, identically to the embodiment variant shown in FIG. 3, is a changeover contour 212 serving the same purpose as the changeover contour 71 of the first control disc 7 according to the embodiment variant shown in FIG. 3.

In contrast to the embodiment variant shown in FIG. 3, a tab 213 is formed here on the opposite circumferential edge of the first control disc 201, which tab extends perpendicularly to the plane of the control disc 201 in the direction of the disc-spring-like spring element 13 on the side of the first control disc 201 facing away from the toothed-ring discs 202.

In the installed state, this tab 213 protrudes into a recess provided for this purpose on the first lever 2, which in this case has an elongated-hole-shaped recess instead of the control pin 12, in which recess the tab 213 can be pivoted through a changeover angle in the circumferential direction of the first control disc 201.

Similar to the friction disc 8 shown in FIG. 7, the friction discs 203 disposed between the toothed-ring discs 202 have a changeover contour 232 extending radially outwardly from the outer circumference of the friction discs 203.

The friction discs 203 further comprise an inner circumferential edge with an internal toothing structure 231, analogous to the friction discs 8.

In contrast to the embodiment variant shown in FIGS. 20 and 21, in which three toothed-ring discs 202 are provided with two interposed friction discs 203, in the embodiment variant shown in FIGS. 22 and 23 two toothed-ring discs 202 are provided with one interposed friction disc 203. In all other respects, the structure of the clamping mechanism of these two embodiments is identical.

The embodiment variant of a further alternative clamping mechanism shown in FIGS. 24 to 26 preferably comprises three toothed-ring discs 302, analogous to the embodiment variant shown in FIGS. 20 and 21, having a respective friction disc 303, 304 arranged between two of the toothed-ring discs 302.

In contrast to the embodiment variants described with reference to FIGS. 20 to 23, in this embodiment variant one of the friction discs 304 has an elevation 343 on its outer circumference 342, which is adjoined by a recess 344 for accommodating a changeover element 305.

The changeover element 305 is thereby adapted to the inner contour of the recess 344 in such a way that it can be pivoted by a predetermined switching angle within the recess 344 about a pivot axis which is disposed coaxially to the pivot axis of the force-transmitting shaft 6, but radially offset therefrom outside the force-transmitting shaft 6, as can also be seen well in FIG. 26.

In this regard, the recess 344 has a substantially V-shaped receiving area for receiving a V-shaped partial section of the changeover element 305.

In this regard, a neck of the changeover element 305 has a circumferential width such that it can pivot within the recess 344 through a predetermined switching angle.

The switching angle is preferably between 8° and 12°. The thickness of this changeover element 305, viewed in the longitudinal direction of the force-transmitting shaft 6, is thereby less than the thickness of the friction disc 304.

In the embodiment variant shown herein, the friction disc 304 is larger than the thickness of the friction disc 303.

The slightly smaller thickness of the changeover element 305 compared to the friction disc 304 makes it possible, in a simple manner, to prevent the changeover element 305 from being jammed by the friction discs 8 pressing against the toothed-ring discs 302 from the outside.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 Pivot fitting
2 First lever
2*a* First cover
2*b* Second cover
21 Lever arm
22 Bending range
23*a* Lever head
23*b* Lever head
24 Bore
25 Receptacle
26 Bore
27 Pivot pin receptacle
3 Second lever
31 Lever arm
32 Lever head
33 Bore
34 Stop
4 Toothed-ring disc
41 Outer toothing structure
42 Inner circumferential edge
5 Catch
51 Catch arm
52 Teeth
53 Pivot pin
54 Recess
55 Run-up chamfer
6 Force-transmitting shaft
61 Outer toothing structure
62 Groove
7 First control disc
71 Changeover contour
72 Recess
8 Friction disc
81 Internal toothing structure
82 Changeover contour
9 Cone
91 Outer circumferential edge
92 Internal toothing structure
93 Slot
10 Spring element
101 Spring steel strip
102 Tooth
11 Second control disc
111 Switching arm
112 Elongated hole
113 Tooth
12 Control pin
13 Spring element

131 Inner circumference
132 Tooth
14 Disc
15 Stop
151 Stop edge
100 Piece of furniture
161 Furniture body
162 Backrest
163 Armrest
201 First control disc
211 Inner diameter
212 Changeover contour
213 Tab
202 Toothed-ring disc
221 Inner circumferential edge
222 Outer teething structure
203 Friction disc
231 Internal toothing structure
232 Changeover contour
301 First control disc
311 Inner diameter
312 Changeover contour
313 Angled region
314 Recess
302 Toothed-ring disc
321 Inner circumferential edge
322 Outer toothing structure
303 Friction disc
331 Internal toothing structure
304 Friction disc
341 Internal toothing structure
342 Outer circumference
343 Elevation
344 Recess
305 Changeover element
D Axis of rotation
V Adjustment direction
R Return direction
$\alpha$ maximum adjustment angle
M Torque
$d_R$ Thickness of the friction disc
$d_U$ Thickness of the changeover element

The invention claimed is:

1. A pivot fitting for movable furniture parts on seating or reclining furniture, the pivot fitting comprising:

a first lever mounted about a force-transmitting shaft serving as an axis of rotation so that the first lever is pivotable from an initial position about a predetermined angle relative to the initial position;

a clamping mechanism configured to fix the first lever in different angular positions within the predetermined angle relative to the-force-transmitting shaft, wherein the clamping mechanism comprises:

a toothed-ring disc fitted onto the force-transmitting shaft and having outer toothing structure integrally formed on an outer edge of the toothed-ring disc;

a catch pivotably mounted on the first lever and loaded in a direction of the outer toothing structure, wherein the catch is engaged with the outer toothing structure in a latching position;

a first control disc rotatably mounted about the force-transmitting shaft, wherein the first control disc is configured so that the catch can be brought out of engagement with the outer toothing structure in an adjustment direction after the predetermined angle has been passed over from the initial position so that, when the catch has been brought out of engagement with the outer toothing structure, the first lever can be pivoted back into the initial position relative to the force-transmitting shaft by passing over the predetermined angle in a return direction; and at least one friction disc arranged on the force-transmitting shaft in a rotationally fixed and axially secured manner is pushed onto the toothed-ring disc, wherein the toothed-ring disc is held in a frictionally locking manner on the at least one friction disc up to a predetermined torque against rotation about the axis of rotation.

2. The pivot fitting of claim 1, wherein an inner circumferential edge of the toothed-ring disc is pushed in a conically shaped manner onto a cone arranged on the -force-transmitting shaft, wherein the at least one friction disc pressingly abuts against the toothed-ring disc on a side of a smaller diameter of the inner circumferential edge of the toothed-ring disc.

3. The pivot fitting of claim 2, wherein the cone is integrally formed on the force-transmitting shaft.

4. The pivot fitting of claim 2, wherein the cone is mounted on the force-transmitting shaft.

5. The pivot fitting of claim 4, wherein the cone is a radially slotted clamping ring.

6. The pivot fitting of claim 2, wherein a cone angle of the cone is between 15° and 35°.

7. Pivot fitting of claim 1, wherein the at least one friction disc includes a first and second friction discs, which are arranged in a rotationally fixed and axially secured manner and are respectively pushed onto opposite sides of the toothed-ring disc.

8. The pivot fitting of claim 1, wherein the toothed ring disc comprises a plurality of toothed-ring discs fitted onto the force-transmitting shaft, wherein the at least one friction disc is arranged between two of the plurality of toothed-ring discs.

9. The pivot fitting of claim 1, wherein the at least one friction disc is pressed onto the force-transmitting shaft against the toothed-ring disc with an interference fit.

10. The pivot fitting of claim 1, wherein the at least one friction disc is a disc spring.

11. The pivot fitting of claim 1, wherein the at least one friction disc has a changeover contour formed on an outer edge of the at least one friction disc.

12. The pivot fitting of claim 1, wherein a recess is integrally formed on an outer edge of the at least one friction disc, in which recess a changeover element is pivotably accommodated about a changeover angle in a plane of the at least one friction disc.

13. The pivot fitting of claim 12, wherein a thickness $d_R$ of the at least one friction disc, measured in a longitudinal direction of the force-transmitting shaft, is greater than a thickness $d_u$ of the changeover element.

14. The pivot fitting of claim 1, wherein the predetermined torque up to which the toothed-ring disc is frictionally held against rotation about the axis by the at least one friction disc is at least 70 Nm.

15. The pivot fitting of claim 1, further comprising:

a second lever coupled in a rotationally fixed manner to the force-transmitting shaft.

16. A piece of furniture, comprising:

a furniture body; and a pivot fitting coupled to the furniture body, wherein the pivot fitting comprises a first lever mounted about a force-transmitting shaft serving as an axis of rotation so that the first lever is pivotable from an initial position about a predetermined angle relative to the initial position;

a clamping mechanism configured to fix the first lever in different angular positions within the predetermined angle relative to the force-transmitting shaft, wherein the clamping mechanism comprises;

a toothed-ring disc fitted onto the force-transmitting shaft and having outer toothing structure integrally formed on an outer edge of the toothed-ring disc;

a catch pivotably mounted on the first lever and loaded in a direction of the outer toothing structure, wherein the catch is engaged with the outer toothing structure in a latching position;

a first control disc rotatably mounted about the force-transmitting shaft, wherein the first control disc is configured so that the catch can be brought out of engagement with the outer toothing structure in an adjustment direction after the predetermined angle has been passed over from the initial position so that, when the catch has been brought out of engagement with the outer toothing structure, the first lever can he pivoted back into the initial position relative to the force-transmitting shaft by passing over the predetermined angle in a return direction; and at least one friction disc arranged on the force-transmitting shaft in a rotationally fixed and axially secured manner is pushed onto the toothed-ring disc, wherein the toothed-ring disc is held in a frictionally locking manner on the at least one friction disc up to a predetermined torque against rotation about the axis of rotation.

17. The piece of furniture of claim 16, wherein the pivot fitting is configured to adjustably fix an armrest or other adjustable furniture part relative to the furniture body.

18. The piece of furniture of claim 17, wherein the pivot fitting further comprises a second lever coupled to the armrest or other adjustable furniture part.

* * * * *